US008800649B2

(12) United States Patent
Mathew et al.

(10) Patent No.: US 8,800,649 B2
(45) Date of Patent: Aug. 12, 2014

(54) SHAPE MEMORY CEMENT ANNULUS GAS MIGRATION PREVENTION APPARATUS

(75) Inventors: Thomas Mathew, Houston, TX (US); Michael H. Johnson, Katy, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 544 days.

(21) Appl. No.: 12/830,039

(22) Filed: Jul. 2, 2010

(65) Prior Publication Data

US 2012/0000648 A1 Jan. 5, 2012

(51) Int. Cl.
*E21B 33/12* (2006.01)
*E21B 33/13* (2006.01)

(52) U.S. Cl.
USPC ..... 166/195; 166/285

(58) Field of Classification Search
CPC ..... E21B 33/13; E21B 33/12; E21B 33/14; E21B 34/14; E21B 33/1208
USPC ..... 166/195, 285, 177.4, 243, 241.4, 241.6, 166/170, 177.3
See application file for complete search history.

(56) References Cited

U.S. PATENT DOCUMENTS

| | | | | |
|---|---|---|---|---|
| 3,183,971 | A * | 5/1965 | McEver et al. | 166/250.14 |
| 4,463,807 | A | 8/1984 | Stoddard et al. | |
| 4,515,213 | A * | 5/1985 | Rogen et al. | 166/123 |
| 5,199,489 | A | 4/1993 | Johnson et al. | |
| 5,327,969 | A | 7/1994 | Sabins et al. | |
| 5,390,742 | A | 2/1995 | Dines | |
| 5,503,227 | A | 4/1996 | Saponja et al. | |
| 6,280,477 | B1 | 8/2001 | Mastrorio et al. | |
| 6,936,574 | B2 | 8/2005 | Dao et al. | |
| 7,060,129 | B2 | 6/2006 | Dao et al. | |
| 7,063,152 | B2 * | 6/2006 | Yeo et al. | 166/285 |
| 7,373,981 | B2 | 5/2008 | Kulakofsky et al. | |
| 7,743,825 | B2 * | 6/2010 | O'Malley et al. | 166/179 |
| 2001/0050169 | A1 | 12/2001 | Nyuyen et al. | |
| 2007/0277979 | A1 | 12/2007 | Todd | |
| 2008/0264647 | A1 * | 10/2008 | Li | 166/373 |
| 2008/0296014 | A1 * | 12/2008 | Richard et al. | 166/187 |
| 2009/0186196 | A1 | 7/2009 | Seffen et al. | |
| 2010/0126735 | A1 | 5/2010 | Allison et al. | |

* cited by examiner

*Primary Examiner* — Shane Bomar
*Assistant Examiner* — Wei Wang
(74) *Attorney, Agent, or Firm* — Steve Rosenblatt

(57) ABSTRACT

The annular space around a tubular string has a shape memory material that is in a low profile configuration for run in. After the desired position is obtained and the annulus has cement delivered to fill the annular space, the shape memory device is triggered to revert to an original shape that spans the annulus to seal the tubular and the wellbore sides of the annular space against gas migration through the cement. The structures can have varying run in shapes and can also have original shapes that when the material is triggered will act to displace cement to enhance its compaction on the tubular or the wellbore wall. Combinations of shape memory alloys and polymers are also contemplated to enhance the seal against gas migration.

23 Claims, 9 Drawing Sheets

SHAPE MEMORY CEMENT ANNULUS GAS MIGRATION PREVENTION APPARATUS

FIELD OF THE INVENTION

The field of this invention is devices that minimize or prevent gas migration through cement in an annular space around a tubular extending to a subterranean location.

BACKGROUND OF THE INVENTION

Tubular strings have been sealed in bores with cement. The setting cement can shrink and pull away from the tubular on either side of an annular space or it can pull away from a borehole wall in an open hole cementing application. There can be other causes too such as incomplete mud cake removal or incomplete drilling fluid removal prior to cementing, subsidence and compaction. Cracks can develop later on due to tectonic activities as well. The present invention focuses on gas migration through the set cement as opposed to mitigation of cracks or openings developed after the cement is set. Gas migration through cement can be a dangerous situation and is one of the discussed causes of the Deepwater Horizon accident in the Gulf of Mexico.

Early efforts to counteract gas migration in cement dealt with methods of delivering the cement or the addition of additives to the cement as illustrated by U.S. Pat. Nos. 5,327,969; 5,503,227; 5,199,489; 6,936,574; 7,060,129 and 7,373,981.

In a wholly unrelated field of artificial hip joints shape memory structures were used to retain fixation cement for the hip joint as described in U.S. Pat. No. 6,280,477.

Other applications have involved packers in the annular space that leave channels for cement and use a variety of biasing devices to get the seal material of the packer against the borehole wall. In U.S. Publication 2010/0126735 FIGS. 2 and 3 a base pipe 56 has support members 54 that leave gaps in the annular space 38 for cement to pass. In the FIG. 2B embodiment the member 54 is a shape memory material designed to apply an incremental force to the swelling member 42 off of the tubular 56 to push against the formation 36. Even as to the borehole wall at 36 there are shortcomings of this design in preventing gas migration along the borehole wall. The swelling material can be damaged during run in to the point of openings developing in the swelling layer. The cement in the annular space can still pull away from the seal 42 even if all else functions as planned if the cement experiences shrinkage that causes it to pull away not only from the seal 42 but also from the tubular string 56.

Another attempt at dealing with cement gas migration was an effort by Halliburton to use rubber sleeves on the tubular exterior so that the sleeves are in the annular space. The idea was to pump the cement into the annulus before the rubber rings swelled to hopefully span the annulus with the hope that gas migration at the tubular could be stopped with a bonded seal of the rubber and that the sleeve would push the cement away as it swelled to the borehole wall before the cement set up. The problem with the design is that the swelling process was so slow that the cement would set ahead of the swelling sleeve so that the outer diameter of the sleeve would never reach the borehole wall and the same issues of gas migrations would still be there as the cement got to the borehole wall and the sleeve outer diameter and shrank from both on setting up, leaving open passages at both locations for gas migration.

Multistable structural members are described in U.S. Publication 2009/0186196.

The present invention addresses the issue of gas migration in a new way. It employs shape memory material structures that are secured to the tubular at one end and that when reverting to an original shape, span the annular space by displacing the cement that has yet to set until contact with the open hole or wellbore wall is made that puts the radiating elements of the structure under a compressive load to seal or at least minimize gas migration between zones through the cement. Optionally, the shape memory or bistable structures can be covered in whole or in part with a swelling material. Those and other features of the present invention will be more readily apparent to those skilled in the art from a review of the description of the preferred embodiment and the associated drawings with an understanding that the full scope of the invention is determined from the appended claims.

SUMMARY OF THE INVENTION

The annular space around a tubular string has a shape memory material that is in a low profile configuration for run in. After the desired position is obtained and the annulus has cement delivered to fill the annular space, the shape memory device is triggered to revert to an original shape that spans the annulus to seal the tubular and the wellbore sides of the annular space against gas migration through the cement. The structures can have varying run in shapes and can also have original shapes that when the material is triggered will act to displace cement to enhance its compaction on the tubular or the wellbore wall. Combinations of shape memory alloys and polymers are also contemplated to enhance the seal against gas migration. An outer coating of a swell material can be used.

BRIEF DESCRIPTION OF THE DRAWINGS

FIG. 1 is a section view of a gas migration barrier during run in;

FIG. 5 shows one configuration of the gas migration barrier made up of parallel discs in the initial shape before run in;

FIG. 11 is the view of FIG. 10 after compaction at above the transition temperature followed by removal of the heat while holding the compaction force to get a low profile for run in;

FIG. 14 is the view of FIG. 13 after crossing the transition temperature and applying a compressive force followed by heat removal while holding the compressive force to get a low profile of the gas migration barrier for run in;

DETAILED DESCRIPTION OF THE PREFERRED EMBODIMENT

Figure 1:
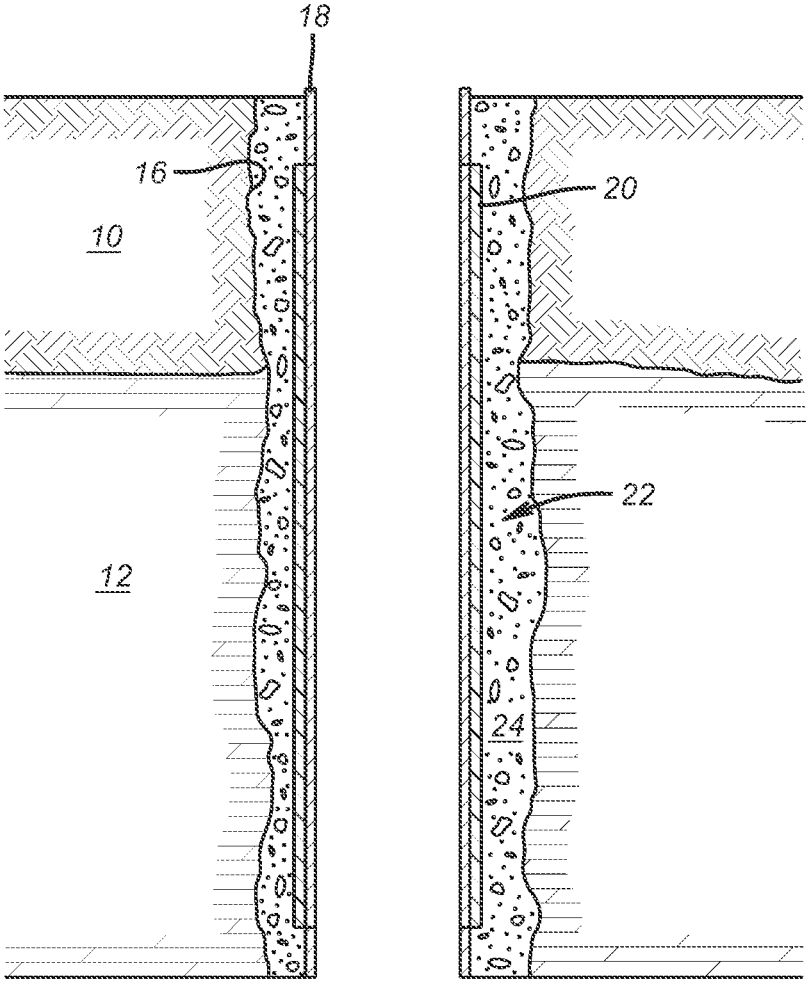

FIG. 1 shows zones 10 and 12 of a formation where there is a borehole 16 that has a string 18, in this example being casing, and a gas migration device 20 in the annular space 22 that will be filled with cement or another sealing material 24. In the run in position the device 20 has a low profile annular shape and is preferably made of a shape memory material. Of the available shape memory materials an alloy is further preferred. Other materials that can be run in with a smaller profile and then converted to another shape or volume with a stimulus that is added to the bore 14 or uses the fluids in the bore 14 can also be deployed such as bistable materials triggered with a mechanical impact or bending force. Bistable materials can be used in isolation as a gas migration device or combined with shape memory materials to aid the transformation of the shape memory device when reverting to an original shape.

Figure 2:
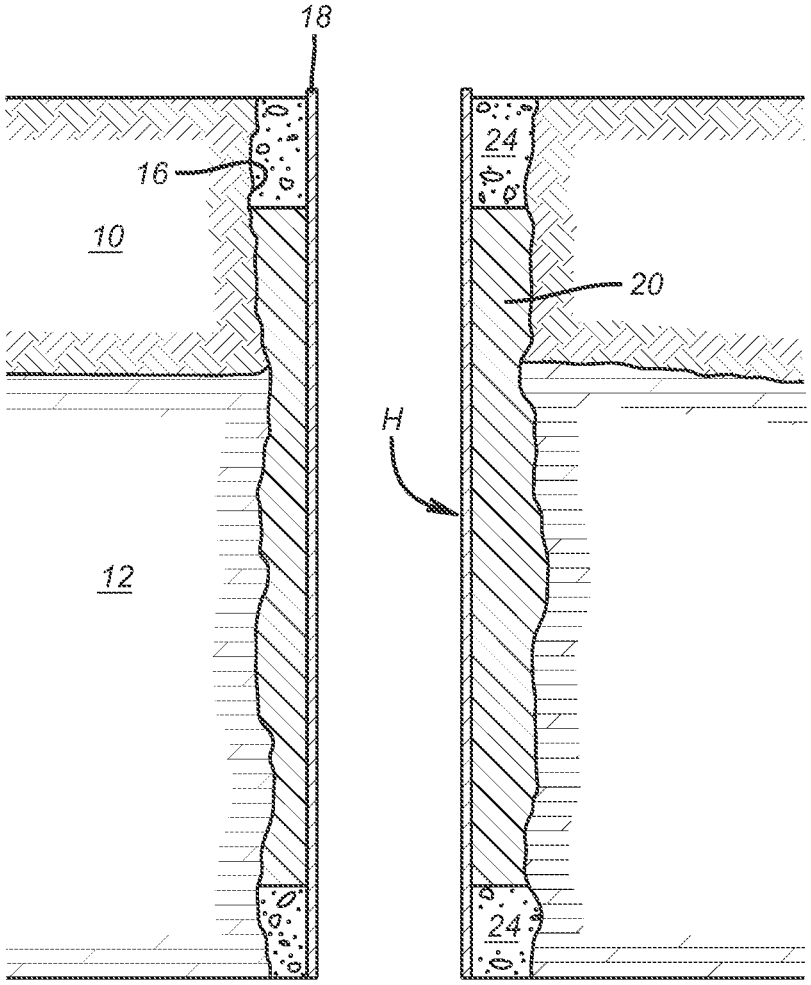
FIG. 2 shows the gas migration barrier deployed.

In FIG. 2 the exposure to well fluids has imparted enough heat to the device 20 to allow it to revert to an original shape that is larger than its run in shape so that contact with the borehole wall 16 is achieved while the cement 24 is pushed out of the way. In this configuration, there is a seal to the tubular 18 and the borehole wall 16 by the device 20. The device 20 in the FIG. 2 configuration has internal compressive stress from pushing against the borehole wall 16 on one side and against the tubular 18 on the opposite side. There are no issues of cement shrinkage as the seal is made in a zone where the cement is displaced before it has had a chance to set up. As an alternative to the use of the well fluids to get the device 20 across its transition temperature so that it can revert to an original shape, auxiliary heat H can be added to initiate the transformation and maintain it to the end position illustrated in FIG. 2. Another available source for heat can be the heat given off by the cement as it sets or from reactions between or among ingredients or additives to the cement 24. A shape memory alloy for the entire device 20 is preferred as alloys will create more compressive stress when abutting the wellbore wall 16 than for example a shape memory polymer. However, alloy and polymer shape memory materials can also be combined in a single device or different compositions of alloys or polymers can be used in a single device as will be discussed below.

Figure 3:
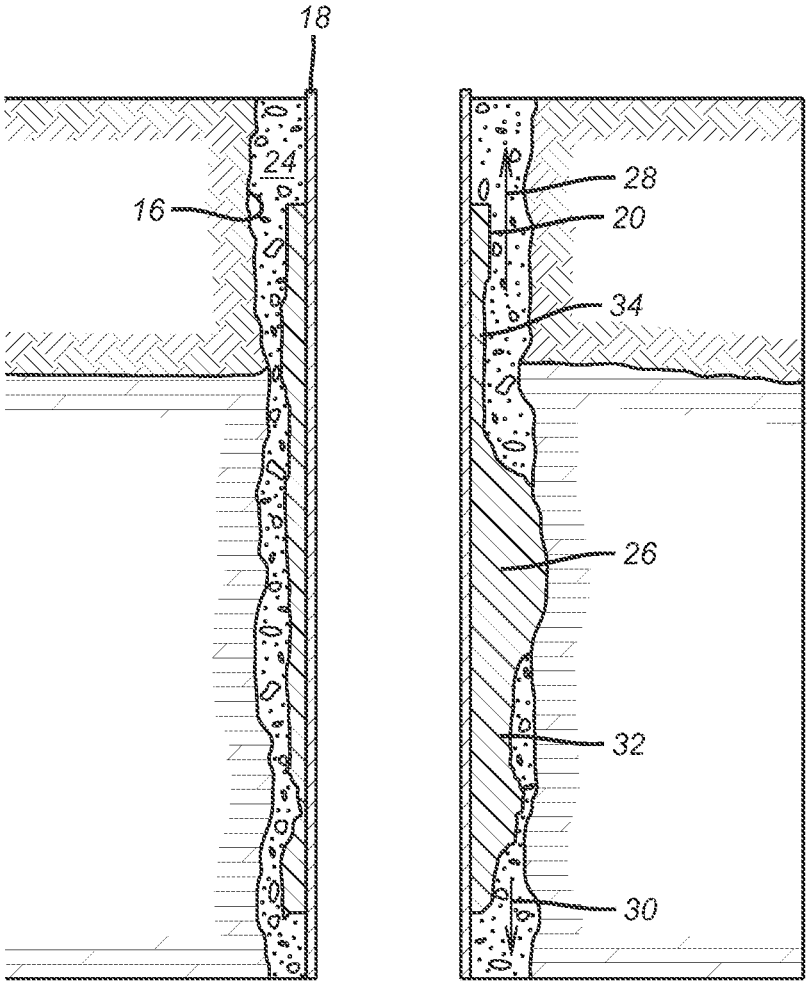
FIG. 3 shows deployment of the barrier that can start in the middle and progress to the opposed ends to displace cement.

FIG. 3 is illustrative of using a mix of materials that trigger at different temperatures to revert to an original shape so that the cement 24 can be more efficiently removed from between the growing device 20 and the wellbore wall 16. For example FIG. 3 shows a portion of a shape memory alloy 26 triggered to revert to the original shape from the middle of the device 20 so that the cement is initially pushed toward opposed ends as indicated by arrows 28 and 30. When the temperature is further increased to a higher level either using the well fluid or external sources such as H, other segments such as 32 and 34 will start in sequence to change shape and any cement 24 between those segments and the wellbore wall 16 will be pushed out beyond the opposed ends of the device 20 in the direction of arrows 28 and 30.

Figure 4:
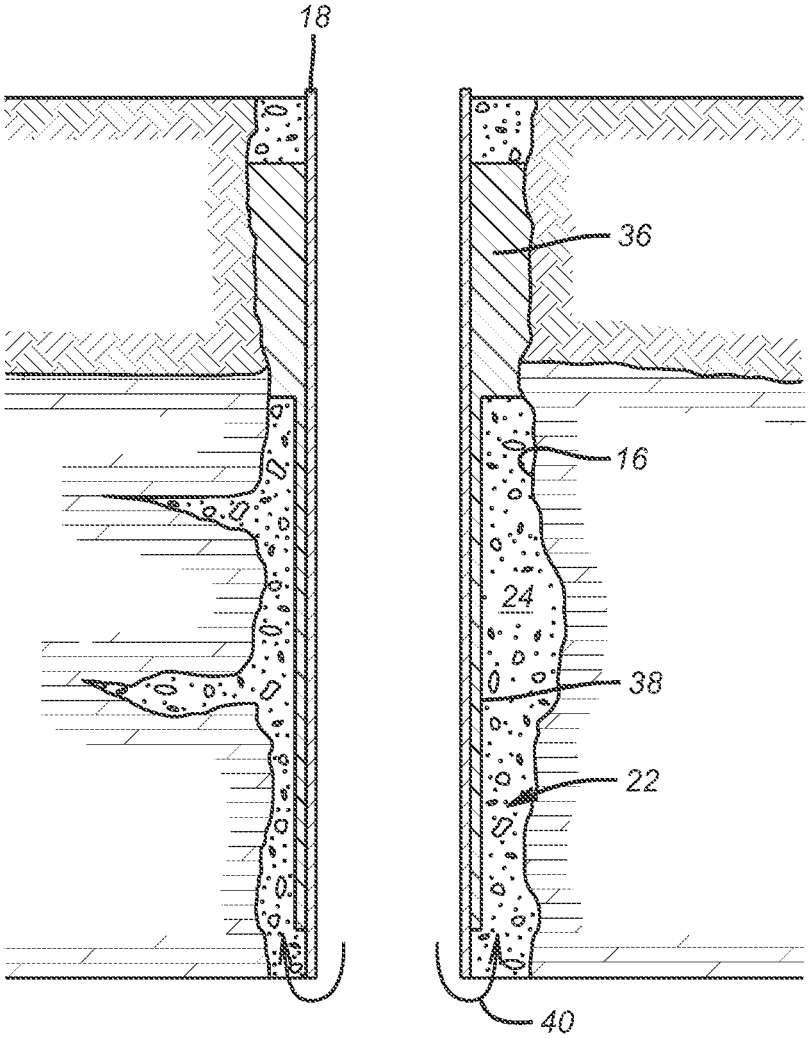
FIG. 4 illustrates a capability of the barrier to act as a piston to displace cement into enhanced contact to the formation and the tubular that define the annular space.

FIG. 4 illustrates a different application of materials that revert to an original shape at differing transition temperatures. In this case the segment 36 moves first and acts as a piston on the cement 24 to drive it toward the wellbore wall 16. Ultimately on reaching an even higher trigger temperature, the segment 38 will begin to revert to its original shape, which is not necessarily the same as the original shape of segment 36. Those skilled in the art will appreciate that the shape change on reversion that is triggered by crossing the transition temperature can involve change in volume to some degree as well as a more dramatic change in shape. In this example the internal pressure in the cement 24 is raised by the device 20. Arrow 40 indicates that there is a one way flow of cement 24 into the annulus 22 usually through a cement shoe that has check valves to prevent cement backflow. Thus the use of the device 20 as a piston is also operative to reduce gas migration through the cement 24 even without forcing out the cement from the entire length of the device 20.

Figure 5:
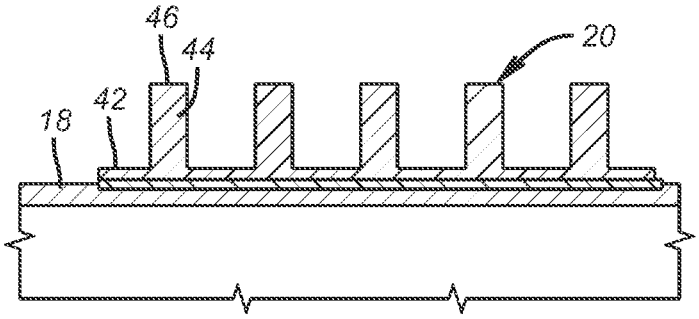

FIG. 5 illustrates a design with an annularly shaped hub 42 sealingly secured to an outer surface of a tubular string 18 with a series of discs 44 having an outer end 46. When this shape is reverted to in the desired location it is intended that the ends 46 engage the formation such as 10 or 12 in a manner where the disc ends 46 are compressed and even slightly misshaped as shown in FIG. 7. The shapes 44 can be equally spaced or randomly spaced. The outer shape at 46 can be circular or rectangular or another shape designed to make fully circumferential contact with the wellbore 10 upon shape reversion when crossing the transition temperature. The original shape of FIG. 5 has to be reduced in profile for running in to the FIG. 7 location. This is done by applying compression while increasing the bulk temperature of the device to above the transition temperature and then holding the compressive force while reducing the temperature of the device 20. In the FIG. 6 configuration, the extending members have been flattened into an essentially annular shape with a fairly low profile as comparing it to the original shape. Note that the extending member shapes are still discernable in FIG. 6 even though the overall profile has been greatly reduced for run in. The benefit of minimizing damage to the device 20 is clearly understood from a comparison of these FIGS. Application of heat from whatever source results in FIG. 7 of a reversion to the FIG. 5 shape. The fact that there is some distortion at the ends 46 reflects that the wellbore 16 may not let each shape fully extend to its original dimension thus forcing some of the ends and preferably all the ends 46 into some degree of deformation indicative that the annulus 22 has been spanned by a shape memory material and that a gas migration seal is in place against the tubular 18 and the borehole 16.

Figure 6:
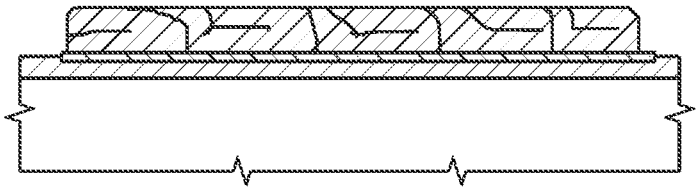
FIG. 6 is the view of FIG. 5 after application of compression above the transition temperature and removal of the heat with compaction forces still applied so that a low profile shape is maintained.
Figure 7:
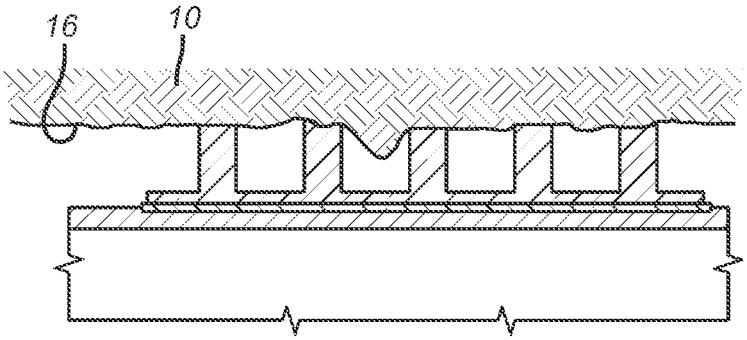
FIG. 7 shows reversion to the original shape at the formation when the temperature again crosses the transition temperature.
Figure 16:
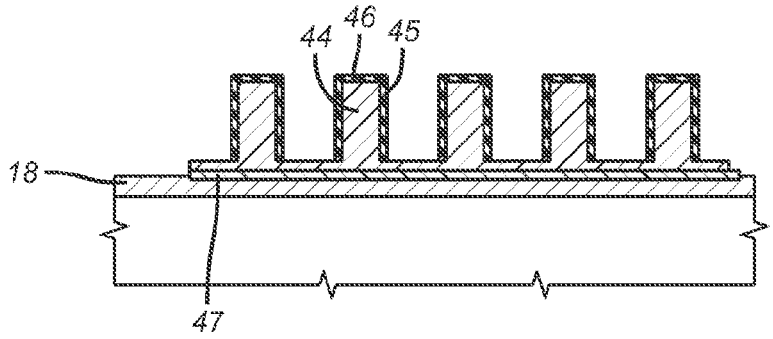
FIG. 16 is an alternative embodiment to FIG. 5 with a swelling material around the projecting members and between the tubular and the gas migration barrier.
Figure 17:
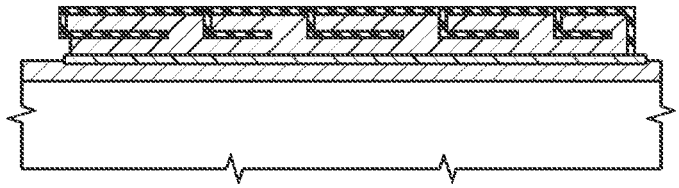
FIG. 17 is the view of FIG. 16 after the combined application of heat and compression followed by removal of heat while maintaining compression to retain the illustrated shape.
Figure 18:
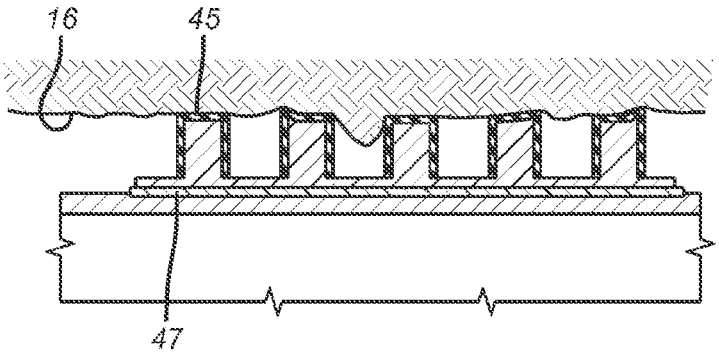
FIG. 18 is the view of FIG. 17 after the addition of heat at the desired location so that the shape attempts to revert to the initial FIG. 16 shape and the swelling material swells to enhance the gas migration barrier performance.

FIGS. 16-18 are an alternative embodiment to FIGS. 5-7 with the difference being the addition of a cover of a swelling material 45 on the shapes 44 and their ends 46. Another layer of a swelling material 47 can be placed between the tubular 18 and the hub 42. Even with the addition of the swelling material 47 the hub 42 can still be affixed to the tubular 18 with fasteners or by welding. The swelling material 45 and 47 can be continuous to wholly envelop the shape illustrated or it can be segmental and applied in locations where it will have the most impact such as at the ends 46 or as one or more rings up against the tubular 18. As before, the original position of FIG. 16 is altered with temperature above the transition point and compression followed by removal of heat while maintaining compression to hold the shape of FIG. 17 for a low profile for running in. When reaching the desired location as shown in FIG. 18 heat from well fluids or/and another stimulus such as impact or bending will cause the gas migration barrier to revert to the FIG. 16 shape with some distortion as shown in FIG. 19 against the borehole wall 16 as the shape retains compressive stress due to contact with the tubular 18 and the borehole wall 16. The well fluids or added fluids will also cause the swelling material such as rubber to change shape or volume both at the tubular 18 and the wellbore wall 16 to compensate for any tendency of the cement to pull away as it shrinks slightly when setting up. Other swelling materials that swell in the presence of hydrocarbons or water are also contemplated.

Figure 8:
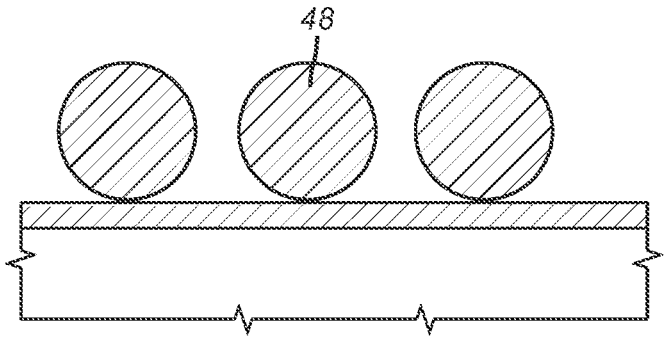
FIG. 8 shows the use of solid rings or a coil in an initial condition before compaction to the supporting tubular.
Figure 9:
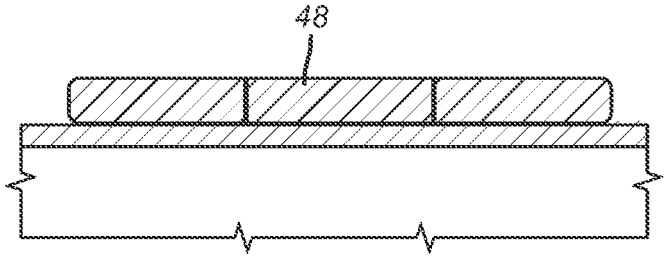
FIG. 9 is the view of FIG. 8 after compaction at above the transition temperature and removal of the heat while still compacting to hold the low profile shape that is depicted.

FIG. 8 illustrates the use of a stack of rings or a coiled spring 48 in an initial configuration using a shape memory material and FIG. 9 is the lower profile configuration for run in that is obtained with compression at above the transition temperature so that an annular cylindrical shape is obtained. Removal of heat with the compression force still applied will result in retention of the FIG. 9 shape until heat is applied from whatever source and the device 20 is at the proper location. At that time the shape will revert to the FIG. 8 shape but the rings 48 will likely not fully assume the original FIG. 8 shape. It is preferred that some deformation of the rings or coil 48 take place so that the shape or shapes can be in compression to form a gas migration seal or at least an impeding structure in the cemented annulus in which the rings or coil 48 are disposed.

Figure 10:
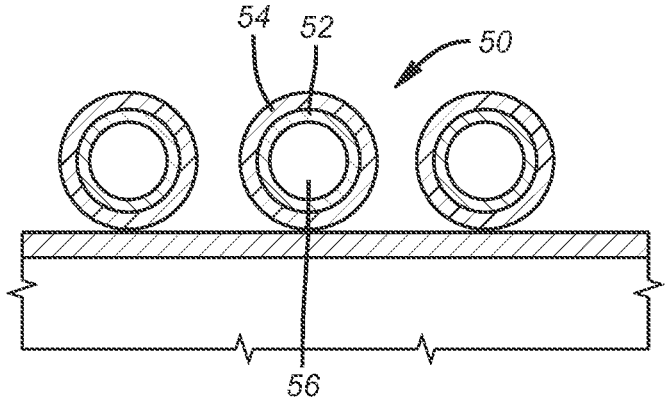
FIG. 10 shows a series of rings or a coil where shape memory polymers are backed by shape memory alloys before compaction at above the critical temperature takes place.
Figure 11:
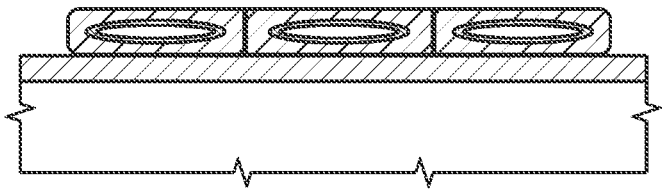
Figure 12:
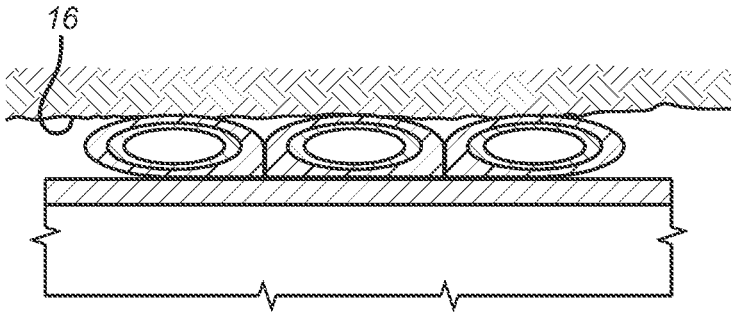
FIG. 12 is the view of FIG. 11 when the transition temperature is crossed near the formation.

FIG. 10 is a variation on FIG. 8 in that the rings or coil 50 are a composite structure with a shape memory alloy internally at 52 and a shape memory polymer on the outside at 54. As before the FIG. 11 position is the low profile position for run in and the FIG. 12 position is after heat is applied at the desired location in the borehole 16. Note that the alloy creates the compressive strength on reversion of shape into contact with the wellbore. On the other hand the polymer is softer on reversion toward the original shape of FIG. 10 so that it acts as a sealing material that is more readily spread by the compressive stress created by the alloy core 52. While a hollow center 56 is used to reduce the required energy to force the initial shape change and to facilitate the reversion to the original shape, a solid center 56 is also envisioned.

Figure 13:
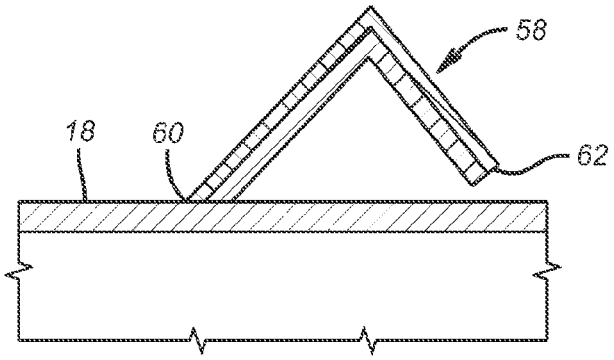
FIG. 13 is an alternative embodiment in its original shape of an angular structure.
Figure 14:
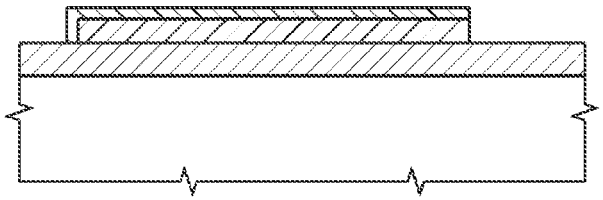
Figure 15:
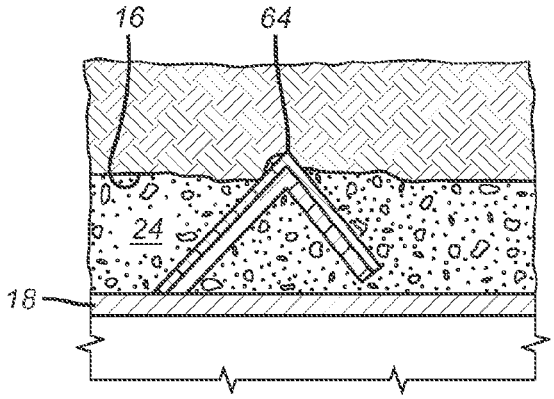
FIG. 15 is the view of FIG. 14 with the transition temperature crossed at the formation and the barrier reverting to its original FIG. 13 shape.

FIGS. 13-15 show another variation of an initial angular shape 58 that is secured at 60 to the tubular 18 and has a cantilevered free end 62 spaced from the tubular 18. Alternatively, the free end 62 can be secured to the tubular 18. As before the transition temperature is crossed with application of compressive force to attain the annular cylinder shape of FIG. 14 followed by heat removal while maintaining the compressive force so that the FIG. 14 shape is obtained. In the wellbore 16 where heat is added to the shape to get the shape above the transition temperature, the result is that the bent portion 64 penetrates the wellbore 16 thereby providing a gas migration seal to the cement 24 by spanning from the tubular 18 to the wellbore wall 16 while displacing the cement 24 from the contact location with the wellbore 16.

Those skilled in the art will appreciate that the present invention in its various embodiments allows for a low profile for run in so that the gas migration device is not likely to be damaged and an ability to change shape and/or volume to span an annular cemented space before the cement sets so that it can function to slow down or eliminate gas migration. The fact that the cement shrinks when setting is not a factor in the operation of the device that spans the annular gap despite the presence of cement. While a shape memory alloy is preferred the entire device can be a composite of different alloys with stages transition temperatures so that portions of the device can deploy in a predetermined sequence so as to more effectively push the cement out of the way before contact with the formation is initiated. The device can also act as a piston to apply a compressive force to the cement to push some of the cement into the borehole wall in formations with fractures or apertures and at the same time to have the device span the annular space so that gas migration can also be retarded or halted by the device. While variations of the device are shown in the drawings in a single location, multiple locations are contemplated. At each location, the design can be a single shape initially or a plurality of adjacent shapes that can be compressed into a single shape when above the transition temperature to get the desired low profile shape. Combinations of alloys and polymers or alloys and foams are contemplated to take advantage of the compressive force that an alloy can create when transitioning back to an original shape and the polymer that gets softer on reverting to an original shape so that it can enhance the sealing capability at the borehole wall. Alternatively, sharp angles such as in FIGS. 13-15 can be used in either a cantilevered design or one supported at multiple locations to the tubular string.

The above description is illustrative of the preferred embodiment and many modifications may be made by those skilled in the art without departing from the invention whose scope is to be determined from the literal and equivalent scope of the claims below.

We claim:

1. A gas migration control assembly for an annular space surrounding a tubular in a subterranean location defined by a borehole wall and further contains a sealing material, comprising:

a tubular having an outer surface;

a sealing material in an annular space between said tubular and the borehole wall;

a gas migration control device having at least one member mounted on the outer surface of said tubular and held in alignment with said outer surface on a long dimension thereof;

said gas migration control device mounted to said outer surface that has a smaller dimension for facilitating insertion to the subterranean location and a larger dimension spanning said annular space with the transition to the larger dimension selectively triggered thermally from well fluid when said annular space in the vicinity of said control device is substantially full with said sealing material so that said thermally triggered shape change of said gas migration control device alone displaces said sealing material in making contact with the borehole wall to at least impede gas migration through said sealing material in said annular space;

said gas migration control device comprises an annular cylindrical shape in said smaller dimension with subsequently extending said at least one member and, when thermally triggered, said at least one member moving away from said alignment with outer surface and generally radially toward the borehole wall to engage the borehole wall such that a compressive stress is generated within said at least one member.

2. The assembly of claim 1, wherein:

said gas migration control device comprises at least one shape memory material.

3. The assembly of claim 2, wherein:

said gas migration control device comprises shape memory polymer mounted over shape memory alloy such that upon triggering said shape memory polymer engages the borehole wall.

4. The assembly of claim 2, wherein:

said gas migration control device is sealingly secured to said tubular in said smaller and said larger dimensions.

5. The assembly of claim 4, wherein:

said at least one member has a rounded outer periphery and substantially parallel orientation with substantially equal axial spacing.

6. The assembly of claim 4, wherein:

said gas migration control device comprises an annular cylindrical shape in said smaller dimension and an angular shape having an intermediate point in said larger dimension.

7. The assembly of claim 6, wherein:

said angular shape has opposed ends with at least one end affixed to said tubular.

8. The assembly of claim 7, wherein:

said intermediate point engaging the borehole wall so that between said end affixed to said tubular and said point gas migration through the sealing material is at least impeded.

9. The assembly of claim 7, wherein:

said gas migration control device initially displaces sealing material from an inner location out toward at least one of said ends.

10. The assembly of claim 4, wherein:

said at least one member comprises a plurality of spaced extending members when thermally triggered each of which comprise a swelling material on an outer periphery thereof.

11. The assembly of claim 10, wherein:

said swelling material covers said at least one member at least in part and is positioned for contact with the borehole wall.

12. The assembly of claim 11, wherein:

said swelling material is disposed against said tubular and said base annular cylindrical shape.

13. The assembly of claim 2, wherein:

said gas migration control device in said larger dimension comprises a plurality of rings or a coiled shape and a hollow or a solid core.

14. The assembly of claim 13, wherein:

said rings or coil further comprising a core of shape memory alloy covered by shape memory polymer with said shape memory polymer contacting and being deformed and carrying a compressive stress by said contact when said transition to said larger dimension occurs.

15. The assembly of claim 2, wherein:

said gas migration control device axially displaces the sealing material to increase the contact pressure of the sealing material to the borehole wall past one end of said device while at least a portion of said device spans said annular space to engage the borehole wall.

16. The assembly of claim 2, wherein:

said gas migration control device comprises a swelling material on an outer periphery thereof.

17. The assembly of claim 16, wherein:

said swelling material covers said gas migration control device at least in part and is positioned for contact with the borehole wall.

18. The assembly of claim 17, wherein:

said swelling material is disposed against said tubular.

19. The assembly of claim 1, wherein:

said selective triggering comprises using heat added to the subterranean location.

20. The assembly of claim 19, wherein:

at least some of said added heat comes from setting up of the sealing material.

21. The assembly of claim 1, wherein:

portions of said gas migration control device are triggered at different temperatures than other portions of the device.

22. The assembly of claim 1, wherein:

wherein said gas migration control device is made at least in part of a bistable material.

23. The assembly of claim 22, wherein:

said gas migration control device is at least in part made of a shape memory alloy.

* * * * *